US006785490B2

(12) United States Patent
Tsukamoto et al.

(10) Patent No.: US 6,785,490 B2
(45) Date of Patent: Aug. 31, 2004

(54) DEVELOPER AND IMAGE FORMATION APPARATUS HAVING DEVELOPER

(75) Inventors: Takeo Tsukamoto, Tokyo (JP); Osamu Satoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/158,144

(22) Filed: May 31, 2002

(65) Prior Publication Data

US 2002/0191982 A1 Dec. 19, 2002

(30) Foreign Application Priority Data

Jun. 1, 2001 (JP) ..... 2001-166694
Jun. 12, 2001 (JP) ..... 2001-177001

(51) Int. Cl.[7] ..... G03G 15/00
(52) U.S. Cl. ..... 399/94; 399/119
(58) Field of Search ..... 399/94, 96, 97, 399/57, 92, 119, 237, 250, 251

(56) References Cited

U.S. PATENT DOCUMENTS 6,400,915 B2 * 6/2002 Nukada ..... 399/94

FOREIGN PATENT DOCUMENTS

| | | |
|---|---|---|
| JP | 5-188754 | 7/1993 |
| JP | 7-248673 | 9/1995 |
| JP | 8-101602 | 4/1996 |
| JP | 8-278696 | 10/1996 |
| JP | 10-97128 | 4/1998 |
| JP | 11-272076 | 10/1999 |
| JP | 2000-112227 | 4/2000 |
| JP | 2000-305344 | 11/2000 |
| JP | 2001-312198 | 10/2001 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A developer includes a development roller which supplies a developing solution to a photosensitive body, transport screws which stir and transport the developing solution, and the like. A high heat conductivity member which serves as a partition is provided between the transport screws, and a radiator which is led to an outside of the developer and which includes a plurality of radiation fins is constituted in an upper portion of the developer. To increase a heat receiving area for receiving heat from the developing solution, a second high heat conductivity member which is formed out of a graphite sheet is bonded to an inner wall surface of a lower casing, and the second high heat conductivity member contacts with the high heat conductivity member.

33 Claims, 15 Drawing Sheets

DEVELOPER AND IMAGE FORMATION APPARATUS HAVING DEVELOPER

FIELD OF THE INVENTION

The present invention relates to a developer which visualizes an electrostatic latent image on an image carrier, and an image formation apparatus, such as a copier, a printer or a facsimile, which has the developer.

BACKGROUND OF THE INVENTION

A high temperature fixing device is provided in an image formation apparatus. With laser exposure, an exposure section (optical writing unit) in the image formation apparatus includes a polygon motor which rotates at high rate and serves as a heat emission source which generates a large amount of heat. Even with LED exposure, a light source generates a large amount of heat. In such an environment, a developer has a mechanism of stirring and transporting a developing material and serving as one of a heat emission sources although the developer is smaller in heat emission quantity than the fixing device and the exposure section.

If an image formation rate is accelerated, it is necessary to stir and transport the developing material at high rate, as well. This is because it is necessary to secure the quantity of the developing material carried by a developing material carrier and for a developer which employs a two-component developing material to stabilize the quantity of toner in the developing material. If a developing material stirring and transporting member, such as a paddle or a screw, in a developing material container is driven at high rate, frictional heat is generated to heat the developing material and to easily deteriorate the developing material. This causes the temperature rise of the developer and also of image formation devices around the developer, thereby producing disadvantages in the operation or image quality of the image formation apparatus.

The ordinary configuration of an image formation apparatus intended to suppress the temperature rise of a developer is such that aluminum or the like having high heat conductivity is used as the material of a casing and an air flow is generated on the outer wall of the casing to thereby accelerate heat exchange. In addition, many apparatuses have been proposed (see, for example, Japanese Patent Application Laid-Open No. 5-188754) each of which air-cools the outside of a developing material container so as to suppress the temperature rise of the developer. To efficiently cool the developing material in the developing material container, in particular, it is effective to cool the bottom of the developing material container which is large in an contact area with the developing material.

At present, there is known, as an image formation apparatus which can form multicolor images, a tandem type image formation apparatus which can output images at a higher rate than that of a revolver type image formation apparatus or a juxtaposition type image formation apparatus since the tandem type image formation apparatus does not perform a color switching operation. However, the tandem type image formation apparatus requires an image carrier for each color, leading to the result that the entire apparatus becomes large in size. To suppress the apparatus from being made large in size, the tandem type image formation apparatus is required to make each image formation unit small in size and to increase the density of the units.

With the configuration of the image formation apparatus intended to suppress the temperature rise of the developer by using a member having high heat conductivity as the casing, if a fixing device is disposed right under the developer or constituent members are crowded, the temperature of the surrounding of the developer is higher than that of the developer, which often makes the developer become a heat receiving side. In addition, if the members are crowded, it is difficult to secure a space which functions as a channel for generating an air flow to suppress temperature rise.

With the configuration of air-cooling the outside of the developing material container, it is difficult to provide a device which directly cools the developing material container in proximity to the developer. In addition, a transfer device which transfers a toner image on a photosensitive drum to a transfer body or an intermediate transfer body and a transport path for the transfer body or the intermediate transfer body are arranged around the photosensitive drum downstream of the developer. Therefore, there is no spatial room for the provision of a cooling unit. According to the conventional art, therefore, it is difficult to sufficiently suppress the temperature rise of the developer in an image formation apparatus, such as the tandem type image formation apparatus, in which constituent members are crowded.

SUMMARY OF THE INVENTION

It is an object of the present invention to provide a developer which can cool the developing material container of the developer irrespective of the outside temperature of the developer even if there is no spatial room around the developer and to provide an image formation apparatus which includes this developer.

According to one aspect of the present invention, there is provided a developer which comprises, a developing material carrier which supplies a developing material which is contained in a casing, to an image carrier, a high heat conductivity member which has high heat conductivity and which contacts with the developing material, and a radiator which is formed by leading the high heat conductivity member to an outside of the developer.

According to another aspect of the present invention, there is provided an image formation apparatus comprising the above-described developer, wherein an electrostatic latent image is formed on the image carrier by an optical writing unit and visualized as a toner image by the developer, and the toner image is transferred to a recording material.

According to still another aspect of the present invention, there is provided an image formation apparatus comprising a developer which comprises, a developing material carrier which carries and transports a developing material, a developing material container which contains the developing material which is supplied by the developing material carrier, and a developing material stirring and transporting member which stirs the developing material in the developing material container, and which apparatus develops an electrostatic latent image on the image carrier, wherein the image formation apparatus comprises, a heat conductive member which conducts heat accumulated in a bottom of the developing material container to a different position, and a cooling unit which cools the heat conducted by the heat conductive member at the different position. The heat accumulated in the bottom of the developing material container is conducted by the heat conductive member from the bottom to the different position and the heat conductive member is cooled at the position by the cooling unit. Therefore, even with the layout on which there is no spatial room for the provision of a unit which directly cools the bottom of the developing material container below the developing material container, it is possible to cool the developing material container of the developer.

Other objects and features of this invention will become understood from the following description with reference to the accompanying drawings.

DETAILED DESCRIPTION (First Embodiment)

A first embodiment of the present invention will be explained hereinafter with reference to FIGS. 1 to 4.

Figure 1:
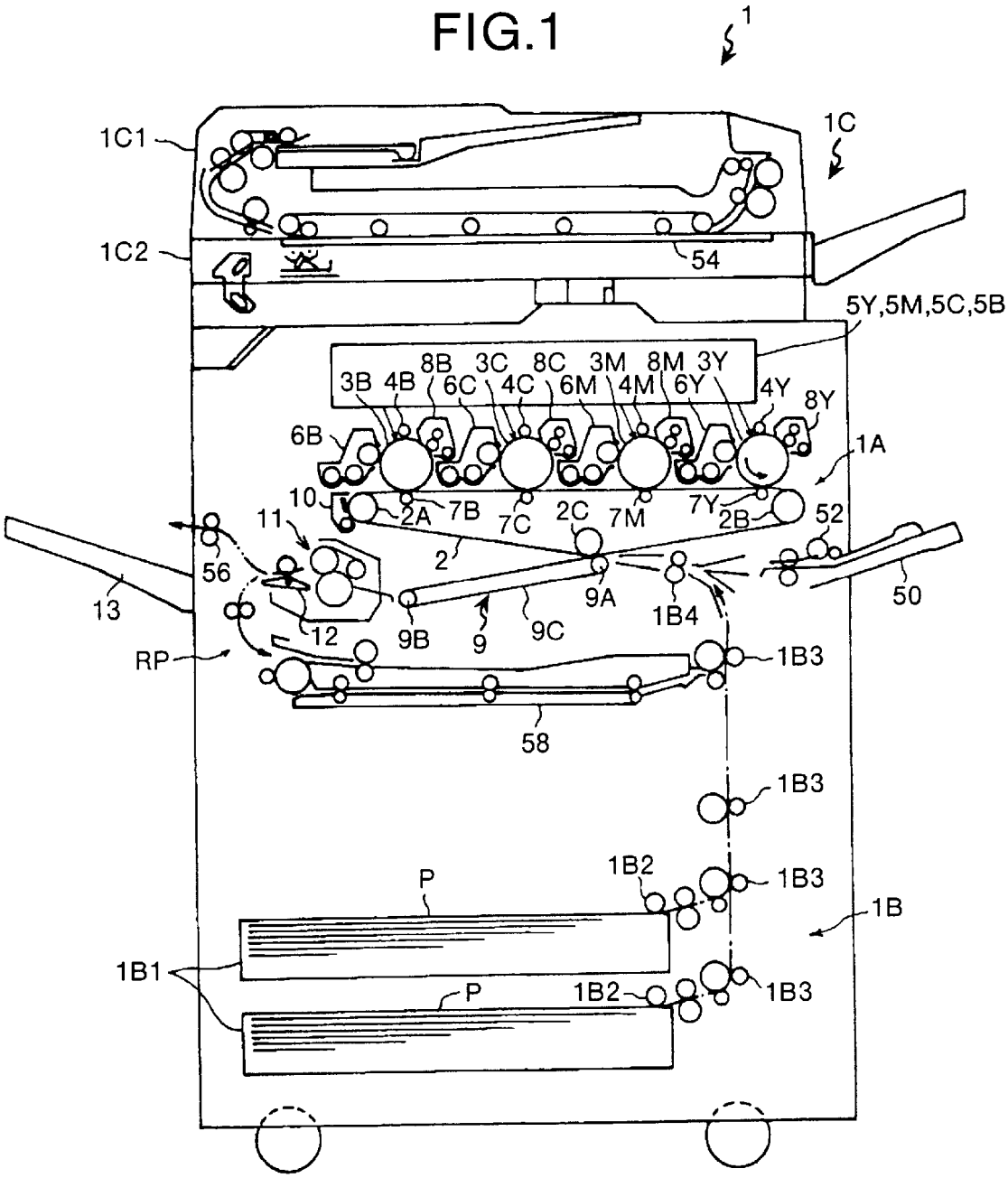
FIG. 1 is a schematic front view of a color copier as an image formation apparatus in a first embodiment of the present invention.

The outline of the configuration and operation of a tandem type color copier as an image formation apparatus in the first embodiment will first be explained with reference to FIG. 1. A color copier 1 includes an image formation section 1A which is located at the center of an apparatus main body, a paper feeder 1B which is located below the image formation section 1A and an image reader 1C which is located above the image formation section 1A.

An intermediate transfer belt 2 which has a transfer surface (extended surface) which extends in a horizontal direction is arranged in the image formation section 1A. A configuration for forming images with colors complementary to color separation colors is provided on the upper surface of the intermediate transfer belt 2. Namely, photosensitive bodies 3Y, 3M, 3C and 3D which serve as image carriers capable of carrying images of color toners (yellow, magenta, cyan and black) in a complementary color relationship are arranged in parallel along the extended surface of the intermediate transfer belt 2.

Each of the photosensitive bodies 3Y, 3M, 3C and 3B consists of a drum rotatable in the same direction (clockwise direction). A charge device 4 which executes an image formation processing during rotation, a write device 5, a developer 6, a primary transfer device 7 and a cleaner 8 are arranged around the drum. Alphabetic characters added to reference symbols correspond to respective toner colors as in the case of the photosensitive bodies 3.

A color toner is contained in each developer 6. The color toner has wax, which serves as a mold release agent, capsulated and dispersed therein and adaptable to an oil-free environment.

The intermediate transfer belt 2 is laid on a plurality of rollers 2A to 2C and constituted to be movable in the same direction at positions opposed to the photosensitive bodies 3Y, 3M, 3C and 3B. The roller 2C other than the rollers 2A and 2B which support the extended surface, stands opposite to a secondary transfer device 9 across the intermediate transfer belt 2. In FIG. 1, reference symbol 10 denotes a cleaner which cleans the intermediate transfer belt 2.

The surface of the photosensitive body 3Y is uniformly charged by the charge device 4Y and an electrostatic latent image is formed on the photosensitive body 3Y based on image information supplied from the image reader 1C. The electrostatic latent image is visualized as a toner image by the developer 6Y which contains a yellow toner. The toner image is primarily transferred to the intermediate transfer belt 2 by the primary transfer device 7Y. Likewise, images are formed on the other photosensitive bodies 3M, 3C and 3B although toner colors differ among them. Toner images of the respective colors are sequentially transferred to the intermediate transfer belt 2 and superimposed.

The toners remaining on the photosensitive body 3 are removed by the cleaner 8, the potential of the photosensitive body 3 is initialized by a charge neutralization lamp, not shown, after the transfer operation in preparation for the next image formation step.

The secondary transfer device 9 has a transfer belt 9C which is laid on a charge driving roller 9A and a driven roller 9B and which is moved in the same direction as that of the intermediate transfer belt 2. By charging the transfer belt 9C by the charge driving roller 9A, a multicolor image which is superimposed on the intermediate transfer belt 2 or a monochrome image carried by the intermediate transfer belt 2 can be transferred to a sheet P which serves as a recording material.

The sheet P is designed to be fed to a secondary transfer position from the paper feeder 1B. The paper feeder 1B is provided with a plurality of paper feed cassettes 1B1 in which sheets P are piled and contained, a plurality of paper feed rollers 1B2 each of which sequentially separates and feeds the uppermost sheet P from the sheets P contained in each paper feed cassette 1B1, transport roller pair 1B3, a resist roller pair 1B4 positioned upstream of the secondary transfer position and the like.

The sheet P fed from the paper feed cassette 1B1 is temporarily stopped by the resist roller pair 1B4, and the slant deviation and the like of the sheet P are corrected. Thereafter, the sheet P is fed by the resist roller pair 1B4 to a secondary transfer position at timing at which the tip end of a toner image on the intermediate transfer belt 2 is consistent with a predetermined position on the tip end section in a transport direction. A manual feed tray 50 which can be freely brought up and down is provided on the right of the apparatus main body. The sheet P contained in the manual feed tray 50 is fed by the paper feed roller 52 and then fed toward the resist roller pair 1B4 by a transfer path which joins a paper transport path continuous with the paper feed cassette 1B1.

In the write device 5, a write optical beam is controlled by image information from the image reader 1C or that which is output from a computer, not shown, and a write optical beam according to the image information is emitted to the corresponding photosensitive body 3Y, 3M, 3C or 3B to thereby form an electrostatic latent image.

The image reader 1C includes an automatic original feeder 1C1, a scanner 1C2 which has a contact glass 54 serving as an original mount and the like. The automatic original feeder 1C1 is constituted to be capable of inverting an original supplied to the contact glass 54 so as to scan the front and rear sides of the original.

The electrostatic latent image on the photosensitive body 3 which is formed by the write device 5 is subjected to a visualization treatment by the developer 6 and primarily transferred to the intermediate transfer belt 2. When toner images of respective colors are super imposed and transferred to the intermediate transfer belt 2, the toner images are secondarily transferred together to the sheet P by the secondary transfer device 9. The sheet P to which the toner images are secondarily transferred is fed to a fixing device 11 and the fixing device 11 fixes unfixed images by heat and pressure. The residual toner on the intermediate transfer belt 2 after the secondary transfer is removed by the cleaner 10.

The sheet P having passed through the fixing device 11 is selectively guided to a transport path toward a discharge tray 13 and an inversion transport path RP by a transport path switching claw 12 which is provided downstream of the fixing device 11. If the sheet P is transported toward the discharge tray 13, the sheet P is discharged to the discharge tray 13 by a discharge roller pair 56 and stacked thereon. If the sheet P is guided to the inversion transport path RP, the sheet P is inverted by an inversion device 58 and fed again to the resist roller pair 1B4.

In the color copier 1 having the configuration thus explained, by subjecting the original mounted on the contact glass 54 to exposure scan or obtaining image information from the computer, an electrostatic latent image is formed for the uniformly charged photosensitive body 3 and visualized by the developer 6, and then a toner image is primarily transferred to the intermediate transfer belt 2.

The toner image transferred to the intermediate transfer belt 2 is transferred to the sheet P supplied from the paper feeder 1B as it is if the toner image is a monochrome image. If the toner image is a multicolor image, primary transfer is repeated to superimpose images, and then the superimposed images are subjected together to secondary transfer.

Unfixed images are fixed to the sheet P after the secondary transfer by the fixing device 11, the sheet P is discharged to the discharge tray 13 or inverted and fed again to the resist roller pair 1B4.

Figure 2:
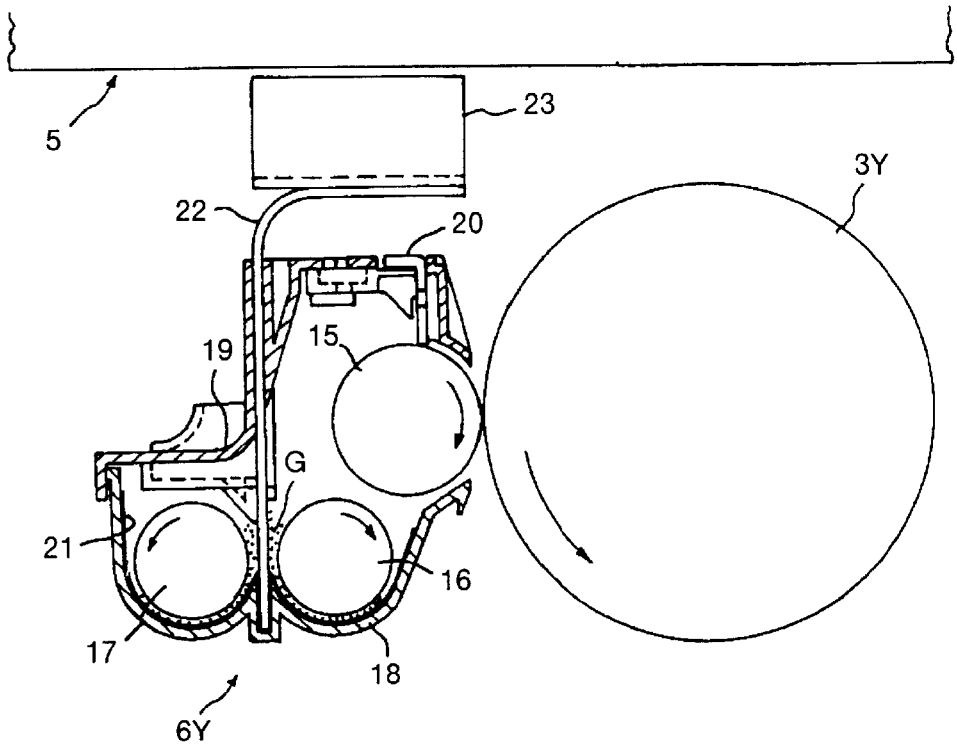
FIG. 2 is a schematic cross-sectional view of a developer which corresponds to a yellow image.

The developer represented by the yellow developer 6Y will next be explained in detail with reference to FIGS. 2 to 4.

The developer 6Y includes a lower casing 18 which contains a developing material G, an upper casing 19 which covers the upper portion of the lower casing 18, transport screws 16 and 17 as developing material stirring and transporting units which stir and transport the developing material G, a development roller 15 as a developing material carrier which receives the developing material G from the transport screw 16, and the like. The upper casing 19 above the development roller 15 is provided with a doctor blade 20 as a developing material restriction member which restricts the thickness of the developing material G on the development roller 15. The lower casing 18 is formed out of resin of low heat conductivity.

The transport screws 16 and 17 are partitioned by a high heat conductivity member 22 which serves as a partition. Each of the transport screws 16 and 17 has a length which extends in the axial direction of the photosensitive body 3Y and the development roller 15 and is driven to rotate so as to circulate the developing material G on developing material transport paths which join each other on the depth side and the front side. As shown in FIG. 4, a second high heat conductivity member 21 is provided on the inner surface of the lower casing 18 with which the developing material G contacts. The lower end of the high heat conductivity member 22 is inserted into and fixed to a concave section 18*a* which is formed at the center of the lower casing 18 so as to contact with the surface of this second high heat conductivity member 21. That is, the contact area between the high heat conductivity member 22 and the developing material G is substantially enlarged by the second high heat conductivity member 21.

The high heat conductivity member 22 is formed out of a plane heat pipe. The upper portion of the member 22 is guided to the outside of the apparatus main body and bent approximately at right angle to form a radiator 23 (omitted in FIG. 1).

Although a heat pipe is normally cylindrical, a plane type heat pipe as a meander heat pipe already exists. Since this plane heat pipe is bendable, the radiating surface of the radiator 23 provided on the upper portion of the pipe can be oriented in the most effective direction.

Normally, a bottom heat type heat pipe having a lower portion heated and an upper portion cooled can exhibit its performance most effectively. Therefore, the configuration of the heat pipe in this embodiment is an optimum heat transport configuration.

The second high heat conductivity member 21 is formed out of a material of high heat conductivity. Specifically, the member 21 is a metal plate, a sheet, a plated member plated on the inner surface of the lower casing 18 or the like. Further, a graphite sheet as a high heat conductivity material (e.g., a PGS graphite sheet manufactured by Matsushita Electric Industrial Co., Ltd. or a GRAFOIL manufactured by Graphtech Corporation) can be used.

The heat conductivity of graphite is high. In addition, heat conduction thereof is anisotropic and heat conductivity in plane direction is far higher than that in thickness direction. Therefore, depending on a multilayer method and the like, the heat conduction with the lower casing 18 lowers, making it possible to prevent the influence of external heat. In addition, graphite has its feature in that the coefficient of friction of the surface of graphite is quite low. Therefore, if the graphite sheet is used on the contact surface with the developing material G, the flow rate of the developing material G increases on the contact surface, accelerating heat conduction.

Further, in this embodiment, the transport screws 16 and 17 are driven to rotate so that the liquid level of the developing material G is higher toward the high heat conductivity member 22 which serves as a partition. By so driving, it is possible to increase the area of the high heat conductivity member 22 which directly performs heat conduction with the developing material G.

Figure 3:
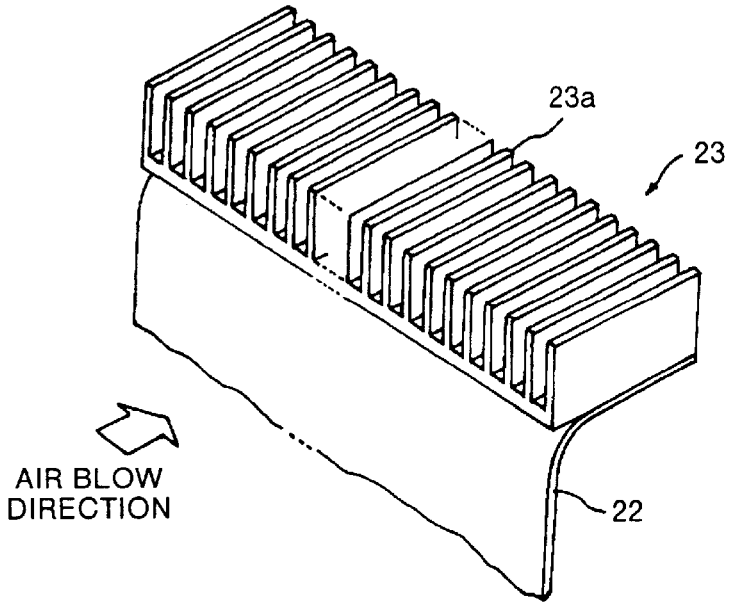
FIG. 3 is a perspective view of a radiator.
Figure 4:
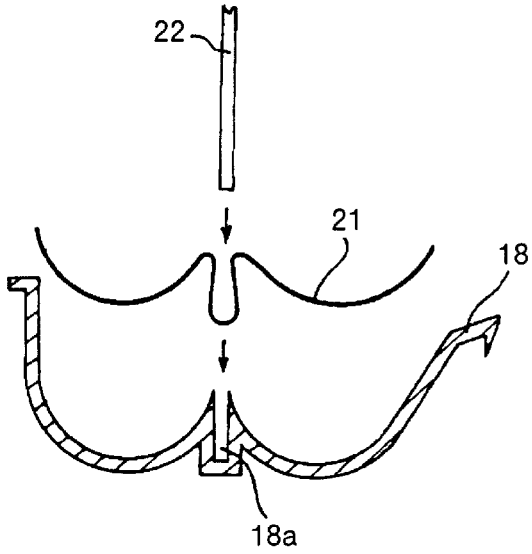
FIG. 4 is an exploded view which shows the connection relation between a high heat conductivity member and a second high heat conductivity member.

As shown in FIG. 3, the radiator 23 has many radiation fins 23*a*. Grooves (channels) which cause air flow to pass are formed between the radiation fins 23*a*. As a whole, the grooves serve as a channel which penetrates the developer 6 for each color. An air blow fan (not shown) which serves as an air flow generation unit is provided on the left side seen in FIG. 1. In FIG. 1, an air flow is generated from left to right on the lower surface of the write unit 5. The air flow passes through the plural grooves so as to be orthogonal to the axial direction of the photosensitive body 3Y. By causing the air flow to pass through the grooves, heat dissipates from the respective radiation fins 23*a* and radiated.

Accordingly, the heat generated by stirring the developing material G by the transport screws 16 and 17 is guided to the outside of the apparatus main body (to the boundary with the write device 5) by the high heat conductivity member 22 and radiated by the radiator 23. If radiation fins are also arranged on the write device 5 side so as not to obstruct an optical path (in which case, it is desirable that the shapes of the fins viewed from an air blow direction are uniform or that the fins are deviated from one another at fixed intervals), then almost a consistent channel is obtained for all colors.

In this case, the channel has a cross section long in the axial direction of the development roller 15. Therefore, it is possible to make the cross-sectional area of the channel large and to efficiently cool an air flow by forming a forced air flow by a cross flow fan.

The configurations of the other developers 6M, 6C and 6B are equal to that of the developer 6Y explained above.

(Second Embodiment)

Figure 5:
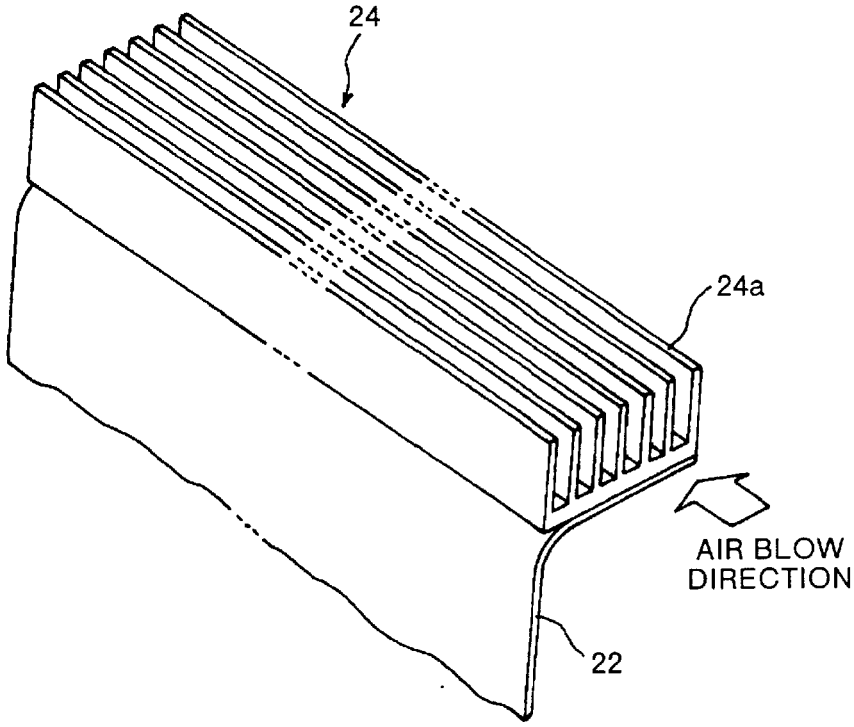
FIG. 5 is a perspective view of a radiator in a second embodiment.

A second embodiment will next be explained with reference to FIG. 5. It is noted that the same sections as those in the first embodiment are denoted by the same reference symbols, respectively and that the configurations and functions thereof will not be explained unless it is necessary to do so. Therefore, only important parts will be explained (the same shall apply to other embodiments hereinafter).

A radiator 24 in the second embodiment has radiation fins 24*a* which extend in parallel to the axial direction of a development roller 15. By so extending, grooves (air flow channels) in parallel to the axis of the development roller 15 are formed.

The air flow channel is relatively small in a cross-sectional area and high in pressure loss. Independent channels are provided for respective colors. Therefore, if there is an image formation section which does not operate during a monochrome operation, it is possible to suppress unnecessary air blow. In addition, it is possible to blow air using a suction air flow, there is no fear of the contamination of the interior of the apparatus by scattering toner without the need to consider the airtightness of the channels.

(Third Embodiment)

Figure 6:
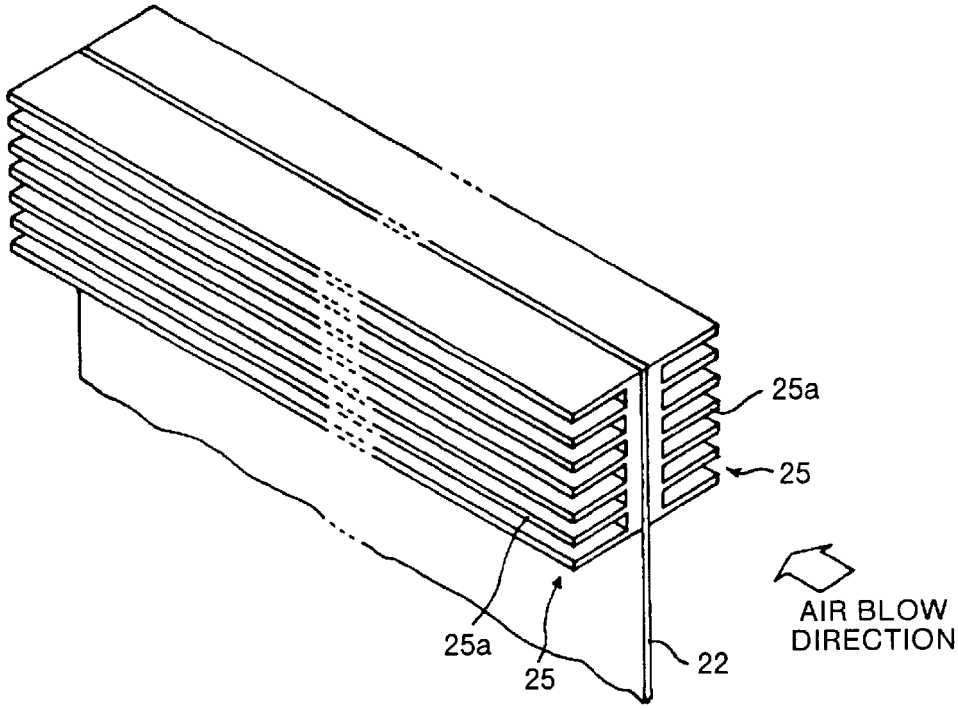
FIG. 6 is a perspective view of a radiator in a third embodiment.

A third embodiment will next be explained with reference to FIG. 6. The upper portion of a high heat conductivity member 22 in the third embodiment extends almost perpendicularly and radiators 25 are provided on the both surfaces of the high heat conductivity member 22, respectively. Each radiator 25 has radiation fins 25*a* which extend in parallel to the axial direction of a development roller 15. By so extending, grooves (air flow channels) in parallel to the axis of the development roller 15 are formed. The function of the channel is the same as that shown in FIG. 5.

(Fourth Embodiment)

Figure 7:
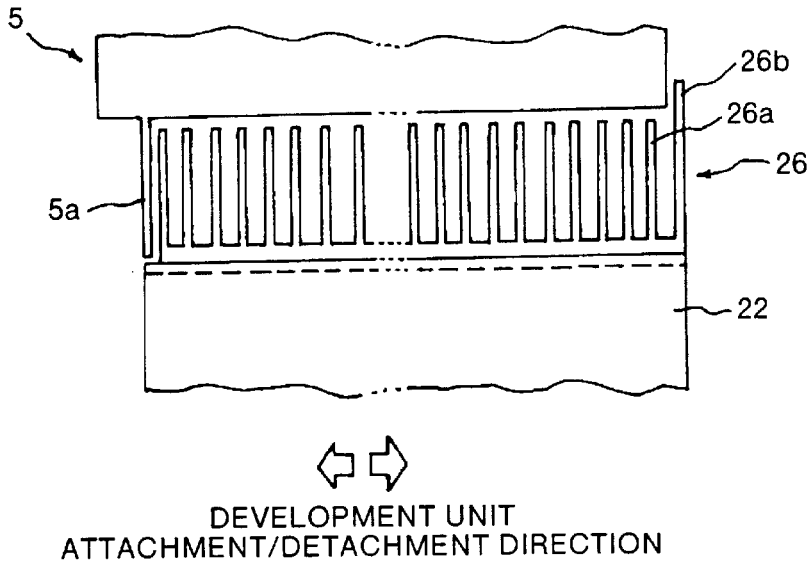
FIG. 7 is a side view of a radiator in a fourth embodiment.

A fourth embodiment will next be explained with reference to FIG. 7. A radiator 26 in the fourth embodiment is almost the same in configuration as that shown in FIG. 3 except that a radiation fin 26*b* which is located on a tip end (front side) in the attachment/detachment direction of a development unit (developer) is formed to be longer (higher) than the other radiation fins 26*a*. Specifically, the radiation fin 26*b* is set to have such a length to be able to maintain airtightness with the frame of the write device 5.

A radiation fin 5*a* is formed deep in the write device 5 in the development unit attachment/detachment direction. The radiation fin 5*a* is set to have such a length to be able to maintain airtightness with the radiator 26. An air blow direction (air flow passage direction) is orthogonal to the development unit attachment/detachment direction.

Normally, the development unit is detachable for maintenance. To carry out maintenance, it is necessary to form gaps between members. However, it is necessary to ensure the airtightness of the channel so as to improve air blow cooling effect. Therefore, by providing an intricate configuration in which the radiation fin 5*a* of the write device 5 is arranged intricately with those of the radiator 26 (particularly with the outside radiation fin), it is possible to make it difficult to pass the air flow of the outer wall portion of the radiator 26 and to improve airtightness.

(Fifth Embodiment)

Figure 8:
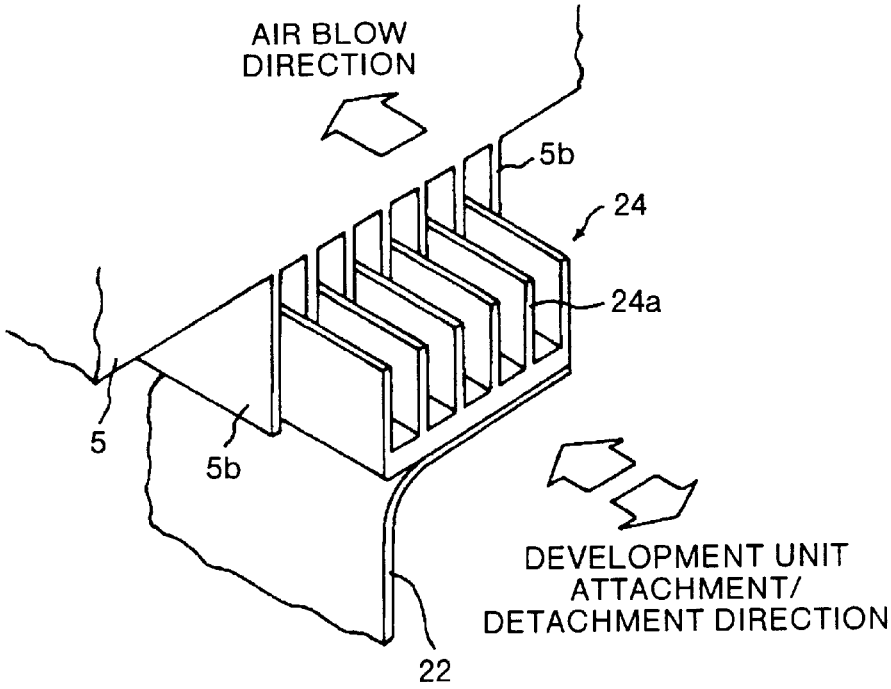
FIG. 8 is a perspective view of a radiator in a fifth embodiment.
Figure 9:
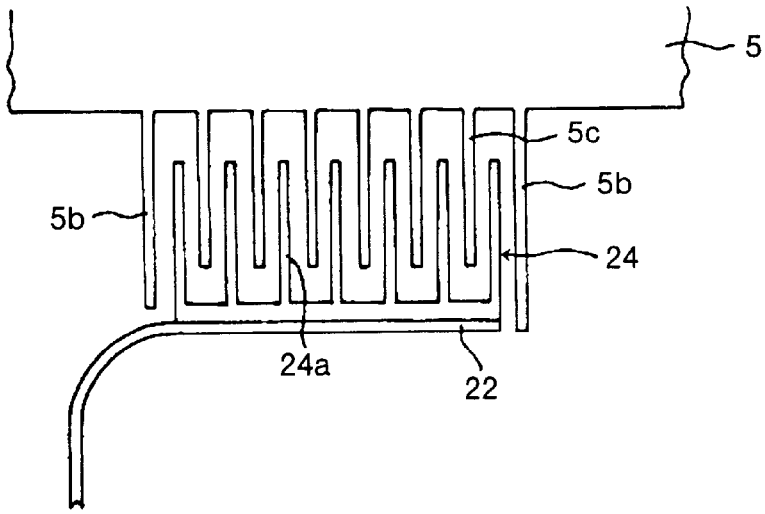
FIG. 9 is a front view of a radiator in the fifth embodiment.

A fifth embodiment will next be explained with reference to FIGS. 8 and 9. In this embodiment, a write device 5 is also provided with radiation fins 5*c* which extend in parallel to the axial direction of a development roller 15 to correspond to a radiator 24. Radiation fins 5*b* on both ends are set to be longer than the other radiation fins 5*c*. By so setting, when a development unit is installed, the radiation fins 24*a* and radiation fins 5*c* are intricately provided, the airtightness of the outer wall portion of the radiator 24 is improved by the radiation fins 5*b* on both ends to make it difficult for an air flow to pass. If narrowing the intricate interval of the radiation fins with the radiation fins 5*b* on both ends, in particular, it is possible to improve the airtightness of the channel.

(Sixth Embodiment)

Figure 10:
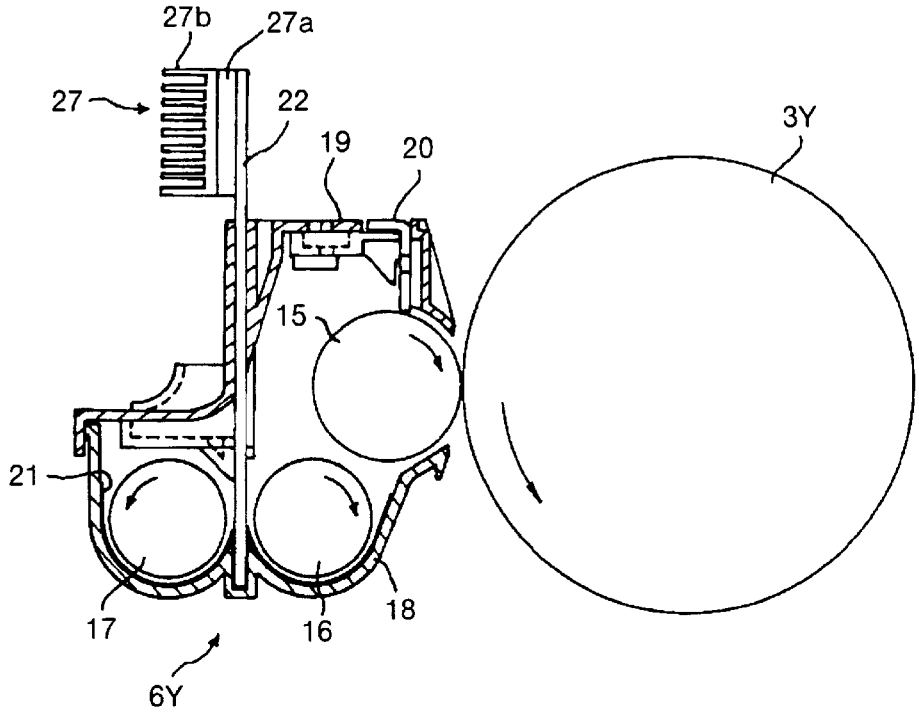
FIG. 10 is a schematic cross-sectional view of a developer in a sixth embodiment.

A sixth embodiment will next be explained with reference to FIG. 10. In the sixth embodiment, the upper portion of a high heat conductivity member 22 is formed to be almost perpendicular and a radiator 27 is provided on this upper portion. The radiator 27 includes a Peltier module 27*a* and a plurality of radiation fins 27*b* which extend in parallel to the axial direction of a development roller 15.

The Peltier module 27*a* has a Peltier element included therein and is integrated with the radiation fins 27*b*. Since the Peltier element forcedly conducts heat by external energy, the degree of freedom for the selection of the material of the high heat conductivity member 22 and for the design of the shape thereof can be advantageously increased.

(Seventh Embodiment)

Figure 11:
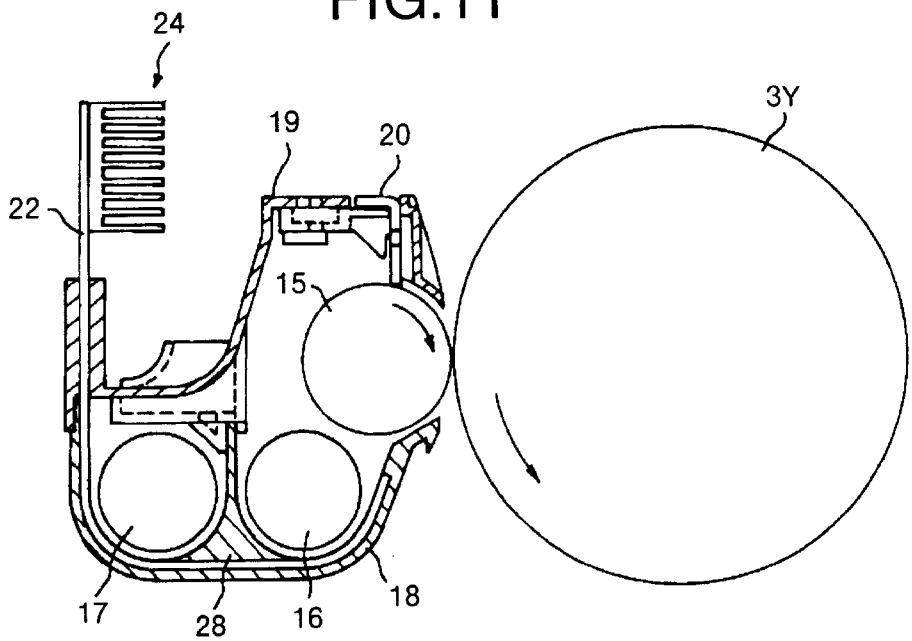
FIG. 11 is a schematic cross-sectional view of a developer in a seventh embodiment.
Figure 12:
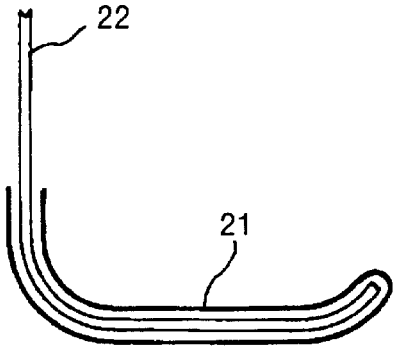
FIG. 12 is a front view of important sections in a heat receiving area enlarging configuration of a high heat conductivity member in the seventh embodiment.

A seventh embodiment will next be explained with reference to FIGS. 11 and 12. In the seventh embodiment, a high heat conductivity member 22 is provided to carry almost half the inner wall-side thickness of a lower casing 18. A partition 28 is provided with the high heat conductivity member 22 as the bottom of the partition 28. The upper portion of the high heat conductivity member 22 extends almost perpendicularly to provide a radiator 24.

The outside of the high heat conductivity member 22 is covered with almost half the thickness of the lower casing 18, i.e., covered with a member which eventually has a heat insulating property depending on the material of the lower casing 18.

It is also possible to adopt a configuration in which a high heat conductivity member such as a graphite sheet is bonded to the surface of the partition 28. In this case, heat is directly conducted between a developing material G and the high heat conductivity member, ensuring high heat receiving efficiency.

The upper portion of the high heat conductivity member 22 can be arranged not vertically but horizontally if there is enough space. In addition, as shown in FIG. 12, it also possible to bond a graphite sheet or the like to the outer periphery of the high heat conductivity member 22 to thereby increase an effective area for receiving heat. In FIG. 12, heat conduction is necessary in a thickness direction. However, if heat conduction in a plane direction is utilized, heat conduction in the thickness direction can be realized by folding the member 22 inward.

(Eighth Embodiment)

Figure 13:
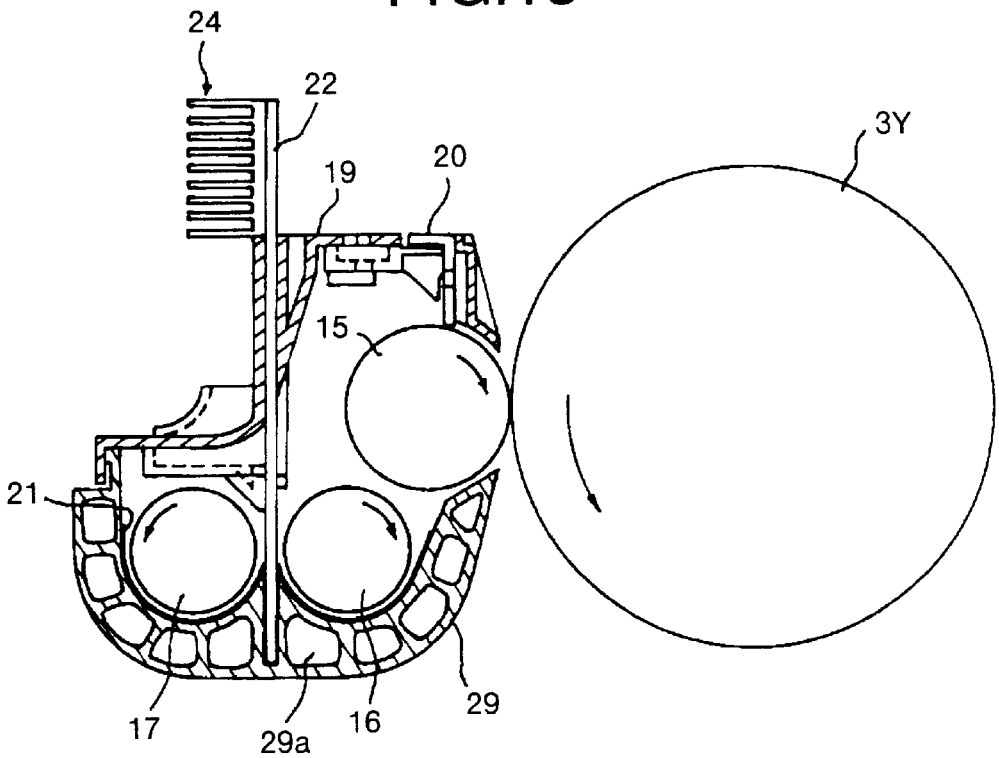
FIG. 13 is a schematic cross-sectional view of a developer in an eighth embodiment.

An eighth embodiment will next be explained with reference to FIG. 13. The eighth embodiment has its feature in that a lower casing 29 has a heat insulating structure in which hollow portions 29*a* are provided. Normally, resin is a bad heat conductor. However, the presence of the hollow portions 29*a* enables the further improvement of heat insulation. To form the lower casing 29, a gas assist method can be utilized, for example. The heat conductivity of materials (resin and air) and the heat resistance of a boundary surface enables heat insulation. This heat insulation enables accurately suppressing the influence of heat from the outside of the developer 6Y.

Normally, to form the lower casing of a developing unit, aluminum extrusion is used. If the aluminum extrusion is used, it is possible to improve heat insulation by forming a thin rib and filling the hollow portions with a material of low heat conductivity.

(Ninth Embodiment)

Figure 14:
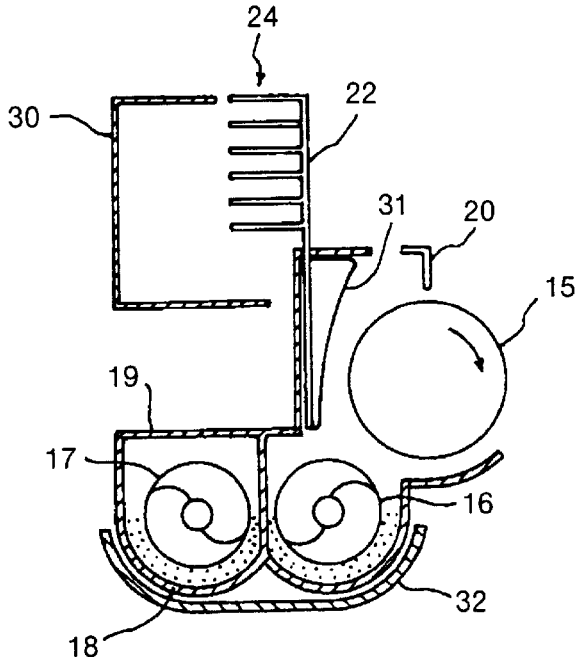
FIG. 14 is a schematic cross-sectional view of a developer in a ninth embodiment.

A ninth embodiment will next be explained with reference to FIG. 14. In the ninth embodiment, a high heat conductivity member 22 is provided in an upper casing 19. The fixed section fixed to the upper casing 19 is provided to be contactable to a developing material G which is intercepted by a doctor blade 20. In addition, a plurality of protrusions 31 shaped to move the intercepted developing material G in the axial direction of a development roller 15 are provided on the fixed section fixed to the upper casing 19.

A duct 30 covers the periphery of a radiator 24 to secure airtightness. In addition, the outer surface of a lower casing 18 is covered with a heat insulating material 32 so as to improve heat insulation.

Each protrusion 31 is a straightening vane which also serves as a heat receiving fin and which accelerates the increase of a heat receiving area and the movement of the developing material G in the axial direction of the development roller 15. In this embodiment, the heat receiver is provided proximate to the radiator 24, so that the degree of freedom for the selection of the material of the high heat conductivity member 22 is advantageously large.

Figure 15:
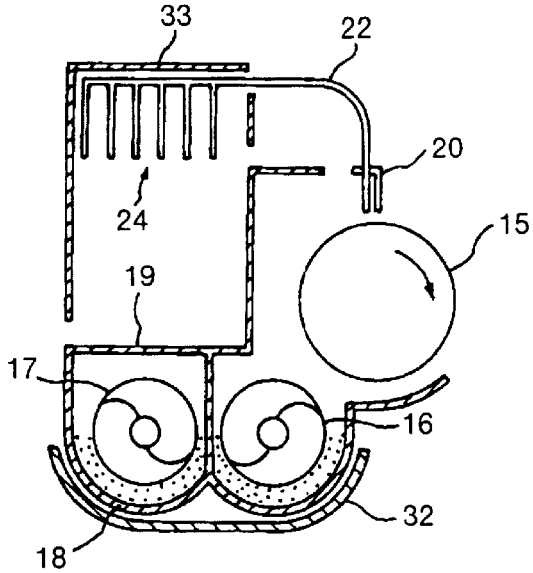
FIG. 15 is a schematic cross-sectional view of a developer in a tenth embodiment.

A tenth embodiment will next be explained with reference to FIG. 15. In the tenth embodiment, the lower end of a high heat conductivity member 22 is provided at a doctor blade 20 to contact the lower end with an intercepted developing material G. The periphery of a radiator 24 is covered with a duct 33. In this embodiment similarly to the ninth embodiment, a heat receiver is proximate to the radiator 24, so that the degree of freedom for the selection of the material of the high heat conductivity member 22 is advantageously large.

In each of the above embodiments, the tandem type image formation apparatus has been shown. Alternatively, an image formation apparatus other than the tandem type apparatus can be similarly worked.

(Eleventh Embodiment)

Figure 16:
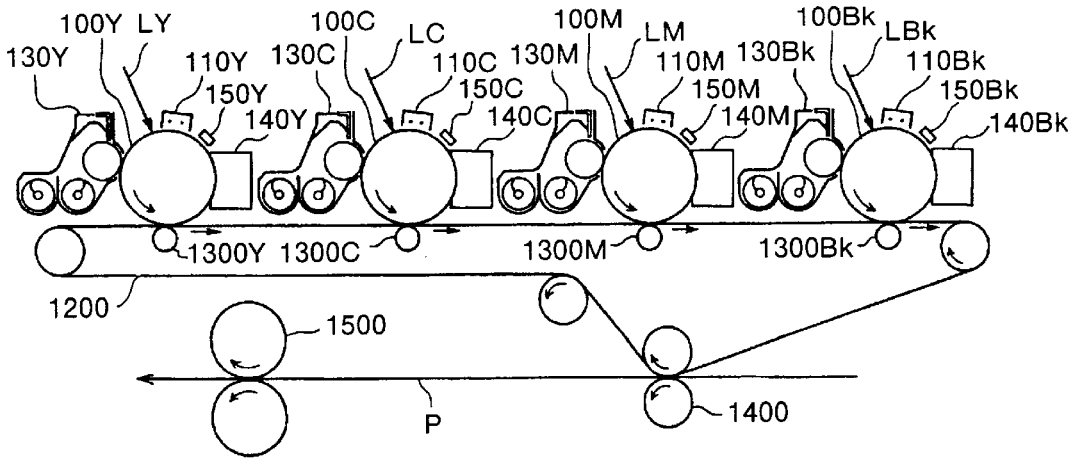
FIG. 16 is a schematic block diagram of an image formation section which employs an intermediate transfer body in an eleventh embodiment.

An eleventh embodiment of the present invention will next be explained. FIG. 16 is a schematic block diagram of an image formation section in the eleventh embodiment. The image formation section forms an image based on color image data obtained in the image reader 1C. In this embodiment, four drum-like photosensitive bodies 100Y, 100C, 100M and 100Bk are provided as image carriers. The photosensitive bodies which correspond to Y, C, M and Bk, respectively are arranged from left to right shown in the figure in parallel almost in the same plane. The photosensitive bodies 100Y, 100C, 100M and 100Bk are provided with charge devices 110Y, 110C, 110M and 110Bk, write devices which are not shown, and developers 130Y, 130C, 130M and 130Bk, respectively.

The surfaces of the photosensitive bodies 100Y, 100C, 100M and 100Bk are charged, for example, negatively by the charge devices 110Y, 110C, 110M and 110Bk provided to correspond to the respective photosensitive bodies. Optical write /LY, /LC, /LM and /LBk is conducted to the photosensitive bodies 100Y, 100C, 100M and 100Bk thus charged by the optical writing units which are the write devices, not shown, provided to correspond to the respective photosensitive bodies. As a result, electrostatic latent images which correspond to image data are formed on the respective photosensitive bodies. The electrostatic latent images are inverted and developed by respective color toners negatively charged by the developers 130Y, 130C, 130M and 130Bk which serve as development units provided to correspond to the respective photosensitive bodies and toner images of respective colors are formed on the photosensitive bodies.

An intermediate transfer belt 1200 as an intermediate transfer body which is opposite to the respective photosensitive bodies 100Y, 100C, 100M and 100Bk and which sequentially transfers toner images of respective colors of yellow, cyan, magenta and black formed on the photosensitive bodies, a plurality of rollers which bridge the intermediate transfer belt 1200, primary transfer rollers 130Y, 130C, 130M and 130Bk which are opposite to the respective photosensitive bodies through the intermediate transfer belt 1200, and a secondary transfer roller 1400 which transfers the toner images on the intermediate transfer belt 1200 to a transfer target material are provided.

The toner images of respective colors of yellow, cyan, magenta and black which are formed on the photosensitive bodies 100Y, 100C, 100M and 100Bk are sequentially transferred to the intermediate transfer belt 1200 by the primary transfer rollers 130Y, 130C, 130M and 130Bk, respectively, and multicolor toner images obtained by superimposing the toner images of respective colors are formed on the intermediate transfer belt 1200. The transfer target material P is fed by a paper feeder toward a transfer target material transport path which is formed between the intermediate transfer belt 1200 and the secondary transfer roller 1400. The secondary transfer roller 1400 transfers multicolor toner images together from the intermediate transfer belt 1200 to the transfer target material P. Further, the multicolor toner images transferred to the transfer target material P are fixed by a fixing device 1500, thereby forming a multicolor image.

Meanwhile, transfer toner remaining on the photosensitive bodies 100Y, 100C, 100M and 100Bk after transferring the toner images to the transfer target material P is removed by the cleaning blades of cleaners 140Y, 140C, 140M and 140Bk as cleaning units which are provided to correspond to the respective photosensitive bodies. Further, charge neutralization lamps 150Y, 150C, 150M and 150Bk as charge neutralization units which are provided to correspond to the respective photosensitive bodies carry out neutralization in preparation for the next image formation step. In addition, residual toner which adheres onto the intermediate transfer belt 1200 after collectively transferring the multicolor toner images is removed by an intermediate transfer belt cleaner which is not shown.

Figure 18:
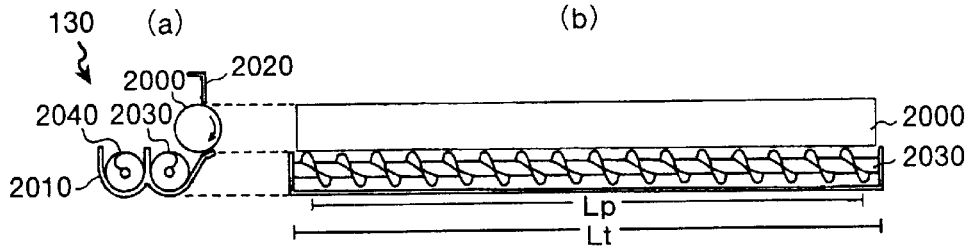

The configurations of the developers will next be explained. The developers 130Y, 130C, 130M and 130BK are equal in configuration except for toner contained therein and operate in the same manner. Therefore, the developer represented by a developer 130 will be explained. FIG. 18(*a*) is a cross-sectional view of the developer 130 viewed from a surface perpendicular to the axis of a development sleeve 2000, and FIG. 18(*b*) is a cross-sectional view of the developer 130 viewed from the longitudinal direction of the development sleeve 2000.

The developer 130 is a two-component developer which employs two-component developing material (to be referred to as "developing material" hereinafter) which consists of toner and a magnetic carrier. The development casing of the developer 130 forms a developing material container 2010 which contains the developing material An opening opened to a photosensitive body 10 is formed in this developing material container 2010. An aluminum development sleeve 2000 which encapsulates a multipole fixed magnet which serves as a developing material carrier is provided in the developing material container 2010 so as to expose a part of the developing material container 2010 through the opening. The developing material container 2010 is also provided with a doctor blade 202 which restricts the quantity of the developing material which is carried by the development sleeve 2000 and transported to a section opposite to the photosensitive body 10, and developing material stirring screws 2030 and 2040 which transport the developing material in the developing material container 2010 to the development sleeve 2000 while stirring the material. The developing material container 2010 is further provided with a toner concentration sensor, not shown, which detects the toner concentration of the developing material contained in the developing material container 2010. In FIG. 18(*b*), reference symbol 1*p* denotes the width of an image formation region and 1*t* denotes the width of the transfer body.

In the developer 130 having this configuration, by rotating the developing material stirring screws 2030 and 2040, the developing material contained in the developing material container 2010 is transported close to the development sleeve 2000 while being stirred. The toner in the developing material is negatively charged by stirring the toner with the magnetic carrier. This developing material is pumped up to the development sleeve 2000 by the rotation of the development sleeve 2000. The developing material is thinned by the doctor blade 2020 and then transported to a development position. The development sleeve 2000 is applied with a development bias obtained by superimposing an AC voltage Vac on a negative DC voltage Vdc by a development bias source, not shown. By forming a development field between the development sleeve 2000 and the photosensitive body 10, the negatively charged toner on the development sleeve 2000 is supplied to the photosensitive body 10. The developing material after the development is transported by the development sleeve 2000 back into the developing material container 2010. Further, the toner concentration detection unit or the like, not shown, monitors the concentration of the toner in the developing material, and the toner, of the quantity used at the development step, is supplemented to the developing material by a toner supply unit, not shown, thereby keeping the toner concentration in the developing material container 2010 constant.

In the developer 130, frictional heat is generated in the developing material by the rotation of the developing material stirring screws 2030 and 2040 and that of the development sleeve 2000. Since the developing material constantly circulates at any position in the developer 130, the temperature of entire developing material in the developer 130 rises almost equally. Most of the heated developing material is present in the lower portion of the developing material container 2010. Therefore, if temperature is measured on the outer surface of the developer 130, the bottom of the developing material container 2010 has the highest temperature. For that reason, it is desirable to cool the bottom of the developing material container which corresponds to the image formation region related to image formation to thereby cool the developing material in the developing material container 2010.

However, since the full-color copier has the intermediate transfer belt 1200 provided below the developing material container 2010, it is difficult to provide a device which directly cools the bottom of the developing material container 2010. Considering this, according to the full-color copier in this embodiment, heat accumulated in the bottom of the developing material container 2010 in a portion which corresponds to the image formation region in the longitudinal direction of the development sleeve 2000 is conducted to the other portion and this other portion is cooled, thereby cooling the developing material in the developing material container 2010.

Figure 19:
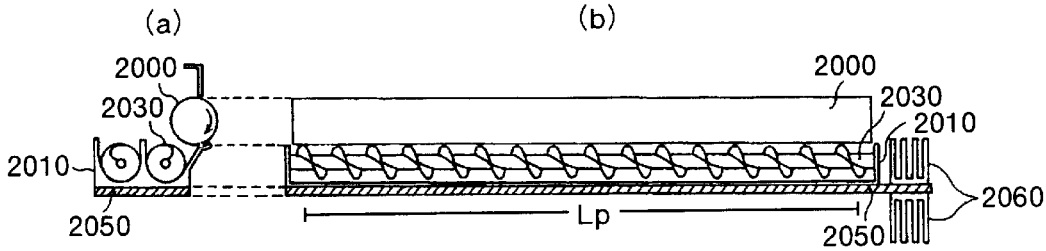

FIG. 19(*a*) is a cross-sectional view which shows the developer in this embodiment viewed from a surface perpendicular to the axis of the development sleeve 2000, and which shows the schematic configuration of the cooling mechanism of the developer. FIG. 19(*b*) is a cross-sectional view of the developer viewed from the longitudinal direction of the development sleeve 2000.

A heat conductive member 2050 which covers almost entirely the bottom of the developing material container 2010 and which extends from the rear end of the developing material container 2010 is provided at the bottom of the developing material container 2010. The heat conductive member 2050 is thermally, closely attached to the bottom of the developing material container 2010. In addition, the developing material container 2010 is formed out of aluminum so as to be able to efficiently conduct the heat of the developing material in the container 2010 to the heat conductive member 2050. In a normal developer designed without consideration to cooling, a developing material container made of resin is used in light of manufacturing cost and light weight. The portion of the heat conductive member 2050 which is protruded from the rear end of the developing material container 2010 is provided with a cooling fin 2060 which serves as a thermally attached heat sink. This cooling fin 2060 is cooled by cooling units which will be explained later. In the developer 130, the length of the developing material container 2010 is set at a minimum which is the sum of the length of an image formation region lp and the margin of the end section. Using the heat conductive member 2050, the heat accumulated in the bottom of the developing material container 2010 in the portion which corresponds to the image formation region lp is conducted to the portion extended from the rear end of the developing material container 2010 and then to the cooling fin 2060 provided on the extended portion. Thereafter, the cooling fin 2060 is cooled, whereby the developing material in the developing material container 2010 can be cooled. As the heat conductive member 2050, a plate-like heat pipe, with a product name "heatlane" manufactured by Astronix Co., Ltd., which consists of a meander narrow tube type heat pipe is used. The thickness of the heatlane is 1.3 mm. If the amount of heat emitted by the friction of the developing material is relatively small, the heat conductive member 2050 can be formed out of a metal plate of high heat conductivity, such as a copper plate, less expensive than the heatlane. In this case, while the heat conductive member 2050 may be plane, it is preferable to use a thick heat conductive member 2050 so as to improve efficiency for conducting heat to the cooling fin 2060.

Figure 20:
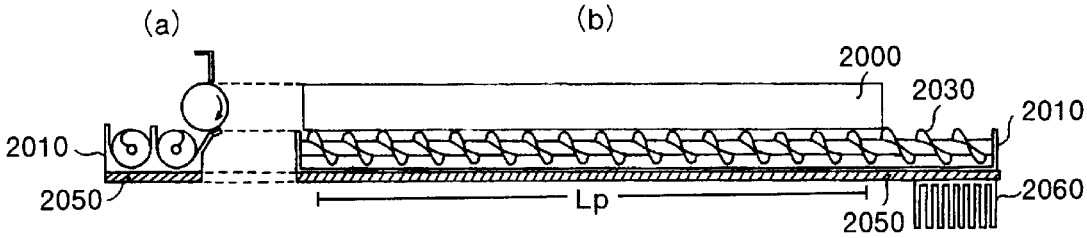

The cooling units which cool the cooling fin 2060 will next be explained. FIG. 20 is a bottom view of the developer if air-cooling units are employed. As the cooling units, an air blow path 2200 which blows an air-cooling air flow to cooling fins 2060Y, 2060C, 2060M and 2060Bk which are provided on heat conductive members 2050Y, 2050C, 2050M and 2060Bk in portions extended from the rear ends of the developing material containers 2010Y, 2010C, 2010M and 2010Bk of the respective developers 130Y, 130C, 130M and 130Bk, and fans 2300 as air blow units which introduce the outside air into the air blow path 2200 and discharge the outside air from the air blow path 220 are provided. The outside air introduced by the fans 2300 into the air blow path 2200 air-cools the cooling fins 2060Y, 2060C, 2060M and 2060Bk and the air is then discharged, thereby dissipating the heat and cooling the cooling fins 2060Y, 2060C, 2060M and 2060Bk.

Figure 36:
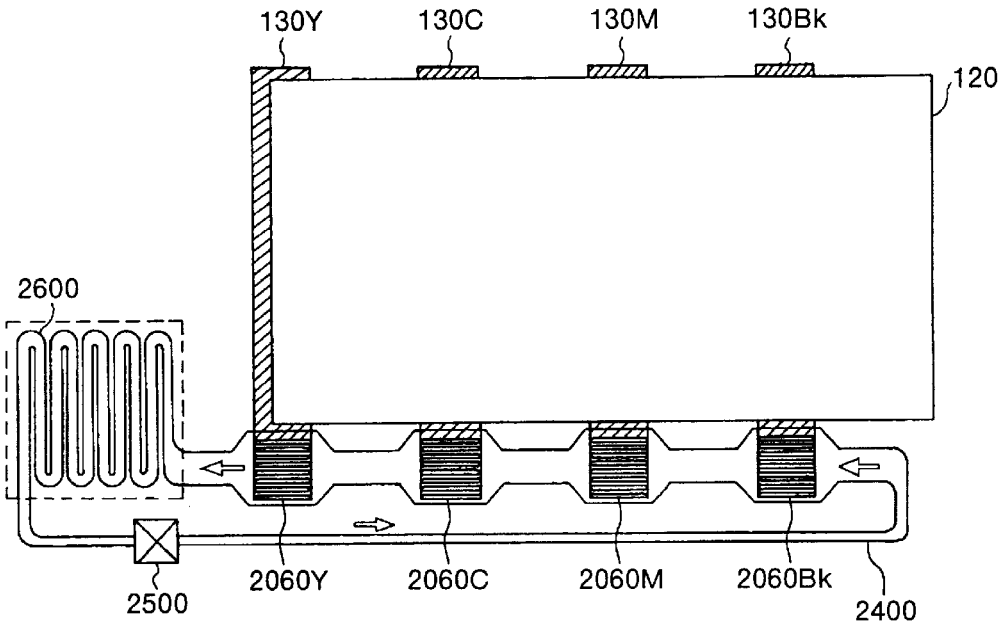
FIG. 36 is a bottom view of an image formation apparatus if coolant cooling units are used.

Alternatively, cooling units by coolant may be used. FIG. 36 is a bottom view of an image formation apparatus if the cooling units by the coolant are used. As the cooling units, a channel 2400 which feeds coolant to the cooling fins 2060Y, 2060C, 2060M and 2060Bk provided to the respective developers 130Y, 130C, 130M and 130Bk, a pump which circulates the coolant in the channel 2400, and a radiator 2600 which radiates the heat of the coolant into the air are provided. The circulating coolant dissipates heat from the cooling fins 2060Y, 2060C, 2060M and 2060Bk and cools the cooling fins 2060Y, 2060C, 2060M and 2060Bk, the heat of the coolant is radiated into the air, the coolant is fed again to the cooling fins 2060Y, 2060C, 2060M and 2060Bk to dissipate heat from the cooling fins 2060Y, 2060C, 2060M and 2060Bk and to cool the cooling fins 2060Y, 2060C, 2060M and 2060Bk. As the coolant, water, oil or the like is used. The cooling units using the coolant are more complex than the air-cooling units since the radiator 2600 is provided. The cooling units using the coolant are, however, advantageous in that a heat dissipating action is great. Therefore, if the same amount of heat is to be dissipated, it is possible to make the cooling fins 2060Y, 2060C, 2060M and 2060Bk smaller than those for the air-cooling units. If the depth of a color copier or the like is restricted, it is possible to advantageously adopt a configuration in which the cooling fins 2060Y, 2060C, 2060M and 2060Bk which are arranged in the portions extended from the rear ends of the developing material containers 2010Y, 2010C, 2010M and 2010Bk are made small in size and the radiator 2600 is provided away from the cooling fins. By arranging the radiator 2600 on the side surface, bottom, rear surface or the like of the color copier so that the radiator 2600 can directly contact with the outside air, the cooling fins are naturally air-cooled. Alternatively, by adopting a configuration in which the outside air is blown to force the cooling fins to be air-cooled, it is possible to further improve the cooling effect.

As explained above, according to the color copier in this embodiment, since the intermediate transfer belt 1200 is arranged below the developers 130Y, 130C, 130M and 130Bk, there is no spatial room for the provision of the units which directly cool the bottoms of the developing material containers 2010Y, 2010C, 2010M and 2010Bk. However, even if there is no spatial room below the developers 130Y, 130C, 130M and 130Bk, it is possible to cool the developing material containers 2010Y, 2010C, 2010M and 2010Bk by providing the cooling units at spatially free positions extended from the rear ends of the developing material containers 2010Y, 2010C, 2010M and 2010Bk of the respective developers 130Y, 130C, 130M and 130Bk, conducting heat to the positions by the heat conductive members 2050Y, 2050C, 2050M and 2050Bk and cooling the cooling fins. Further, since the cooling fins 2060Y, 2060C, 2060M and 2060Bk and the cooling units are provided at spatially free positions extended from the rear ends of the developing material containers 2010Y, 2010C, 2010M and 2010Bk, respectively, it is possible to design the color copier which has a large degree of freedom for the arrangement and which can easily obtain the cooling effect.

The modifications of the developer 130 will next be explained.

[First Modification]

FIG. 20(*a*) is a cross-sectional view of the surface of a developer 130 in a first modification, perpendicular to the axis of a development sleeve 2000. FIG. 20(*b*) is a cross-sectional view of the developer 130 which is viewed from the longitudinal direction of the development sleeve 2000. According to the developer in the eleventh embodiment, a developing material container 2010 is extended rearward to become far longer than an image formation region lp. A thermally, closely attached heat conductive member 2050 is provided in the entire bottom of the extended developing material container 2010. A cooling fin 2060 is provided below the heat conductive member 2050 in the portion greatly extended compared with the image formation region Lp of the developing material container 2010. In the developer in the first modification, a developing material in the developing material container 2010 circulates by the rotation of developing material stirring screws 2030 and 2040. It is, therefore, possible to give a large cooling effect to the developing material which is temporarily present in the extended portion of the developing material container 2010. Accordingly, heat conduction is performed not only by the heat conductive member 2050 of the developer 130 but also by the circulation of the developing material itself, making it possible to obtain a more efficient cooling effect.

[Second Modification]

Figure 21:
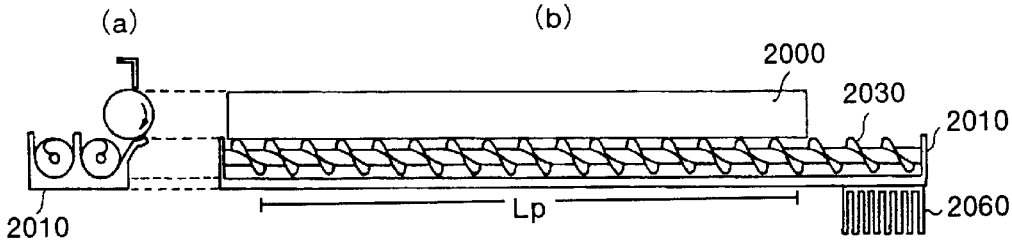

FIG. 21(*a*) is a cross-sectional view of the surface of a developer 130 in a second modification, perpendicular to the axis of a development sleeve 2000. FIG. 21(*b*) is a cross-sectional view of the developer 130 which is viewed from the longitudinal direction of the development sleeve 2000. The configuration of the developer in the first modification is modified in the second modification so that a developing material container 2010 functions as a heat conductive member without separately providing a heat conductive member 2050. The developing material container 2010 is formed out of aluminum and the aluminum thickness of the bottom of the developing material container 2010 is set larger so as to ensure good heat conduction in the axial direction. As a result, it is possible to cool the developing material container 2010 with a simple configuration. This is an effective developer if the quantity of heat emitted by the friction of the developing material is relatively small.

[Third Modification]

Figure 22:
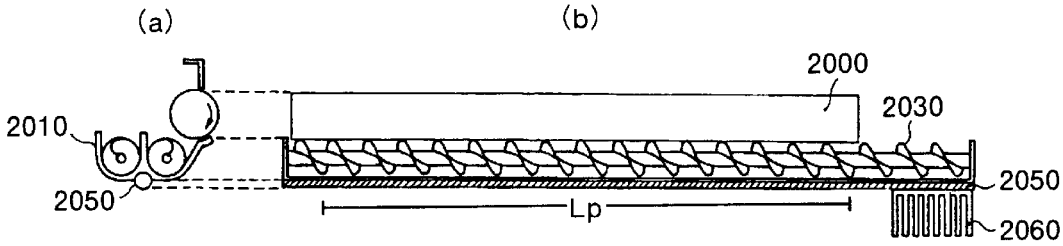

FIG. 22(*a*) is a cross-sectional view of the surface of a developer 130 in a third modification, perpendicular to the axis of a development sleeve 2000. FIG. 22(*b*) is a cross-sectional view of the developer 130 which is viewed from the longitudinal direction of the development sleeve 2000. The configuration of the developer in the first modification is modified in the second modification so that a cylindrical heat pipe instead of a plate member is provided as a heat conductive member in the bottom of the developing material container 2010. In addition, the developing material container 2010 is formed out of aluminum so as to be able to efficiently conduct heat in the developing material to the heat pipe. In a cooler, a cooling fin 2060 is provided in the heat pipe and the bottom of the aluminum developing material container 2010. This configuration enables highly efficient cooling with a small-sized developer.

[Fourth Modification]

Figure 23:
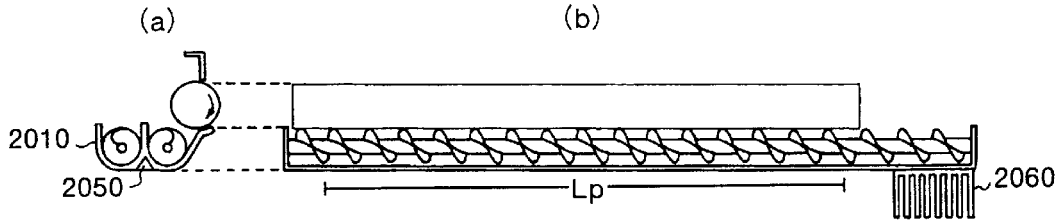

FIG. 23(*a*) is a cross-sectional view of the surface of a developer 130 in a fourth modification, perpendicular to the axis of a development sleeve 2000. FIG. 23(*b*) is a cross-sectional view of the developer 130 which is viewed from the longitudinal direction of the development sleeve 2000. The configuration of the developer in the third modification is modified in the fourth modification so that a cavity (of a cross section of, for example, triangular shape) which is extended in a direction along the screw axis is provided, as a heat conductive member, in a part of the bottom of the developing material container 2010 instead of providing the cylindrical heat pipe in the bottom of the developing material container 2010 and that the cavity is evacuated to thereby seal an operating solution used in the heat pipe. According to this configuration, a part of the bottom of the developing material container 2010 serves as the heat pipe. In addition, the developing material container 2010 is formed out of aluminum so as to be able to efficiently conduct heat in the developing material to the heat pipe. This developer can cool the developing material container more efficiently with the small-size configuration.

[Fifth Modification]

Figure 24:
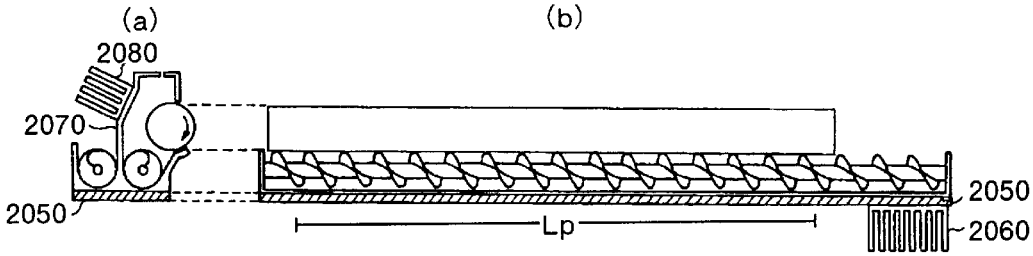

FIG. 24(*a*) is a cross-sectional view of the surface of a developer 130 in a fifth modification, perpendicular to the axis of a development sleeve 2000. FIG. 24(*b*) is a cross-sectional view of the developer 130 which is viewed from the longitudinal direction of the development sleeve 2000. The configuration of the developer in the first modification is modified in the fifth modification so that a sill section which is formed out of aluminum and provided between developing material stirring screws 2030 and 2040 is extended upward of the developing material container 2010 to serve as a heat conductive member 2070 and that a different cooling fin 2080 is provided on the heat conductive member 2070. The cooling fin 2080 is provided proximate to the bottom of the developing material container 2010 and cooled. Therefore, the cooling effect of the developer in the first modification is improved to thereby ensure very highly efficient cooling. Furthermore, it is possible to cool the developing material which is restricted by a doctor blade 202 and held on the development sleeve 2000.

[Sixth Modification]

Figure 25:
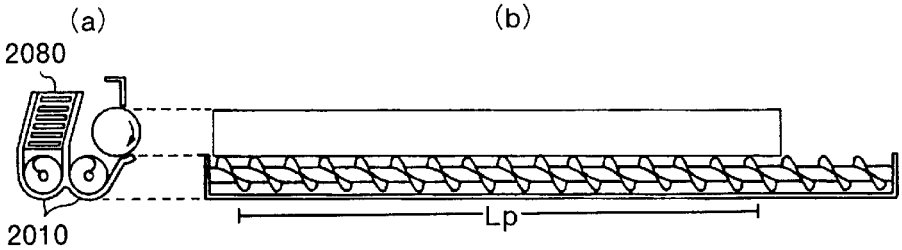

FIG. 25(*a*) is a cross-sectional view of the surface of a developer 130 in a sixth modification, perpendicular to the axis of a development sleeve 2000. FIG. 25(*b*) is a cross-sectional view of the developer 130 which is viewed from the longitudinal direction of the development sleeve 2000. This developer 130 is constituted so that the developing material container 2010 functions as a heat conductive member and that the developing material container 2010 itself is formed out of a heatlane. Besides, a section which surrounds developing material stirring screws 2030 and 2040 and extends upward from the bottom of the developing material container 2010 is provided. A cooling fin 2080 is provided in the upward extended portion. The upward extended portion of the developing material container 2010 which is formed out of a heatlane conducts heat at the bottom of the container 2010 to the cooling fin 2080 which is located proximate to the bottom to thereby cool the cooling fin 2080. It is, therefore, possible to ensure very highly efficient cooling. Alternatively, the developer 130 having this configuration can be formed out of copper or aluminum instead of the heatlane.

[Seventh Modification]

Figure 26:
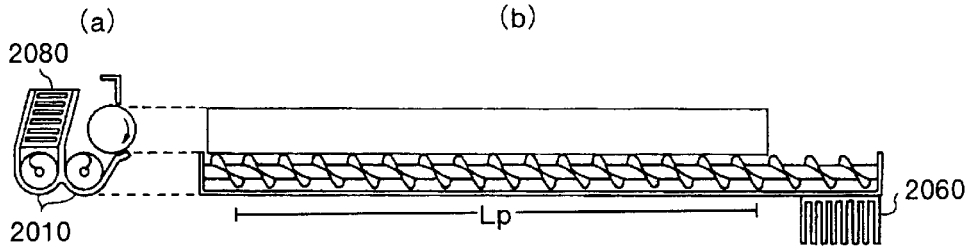

FIG. 26(*a*) is a cross-sectional view of the surface of a developer 130 in a seventh modification, perpendicular to the axis of a development sleeve 2000. FIG. 26(*b*) is a cross-sectional view of the developer 130 which is viewed from the longitudinal direction of the development sleeve 2000. This developer 130 is a modification of the developer in the sixth modification and constituted so that a cooling fin 2060 is also provided on the rear end of the developing material container 2010 and cooled together, thereby further ensuring highly efficient cooling.

[Eighth Modification]

Figure 27:
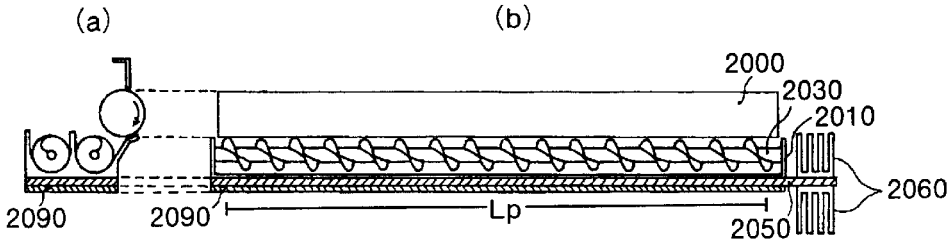
Figure 28:
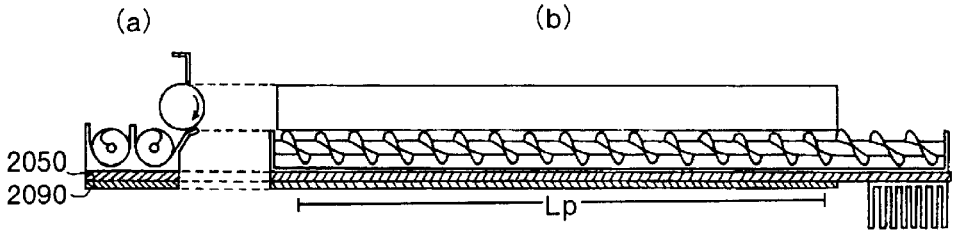
Figure 29:
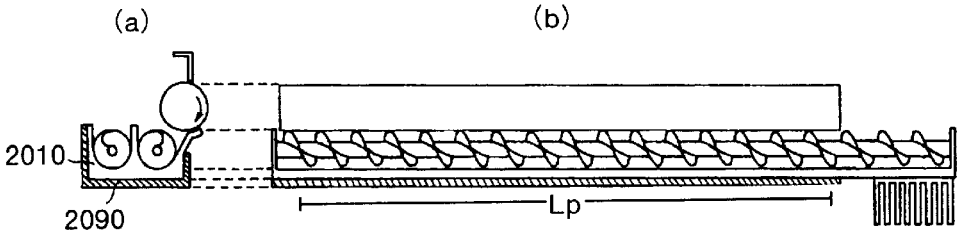
Figure 30:
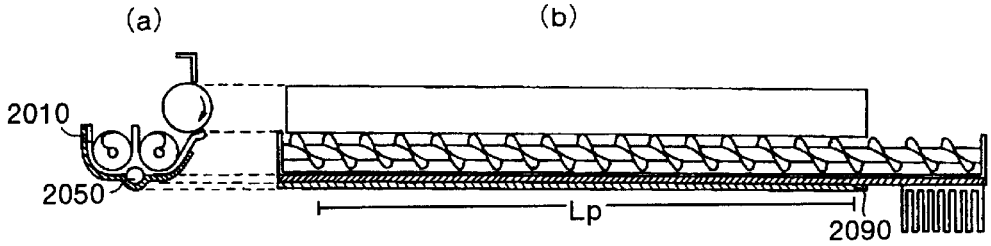
Figure 31:
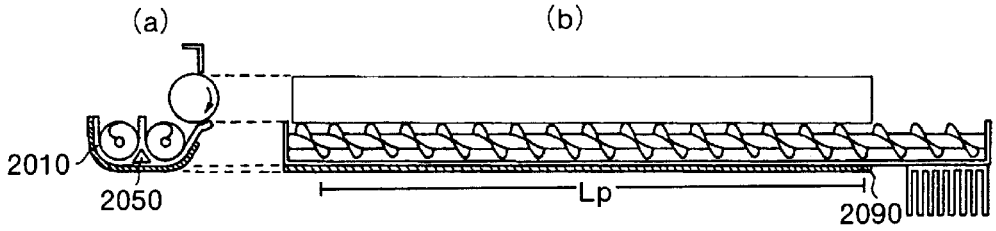
Figure 32:
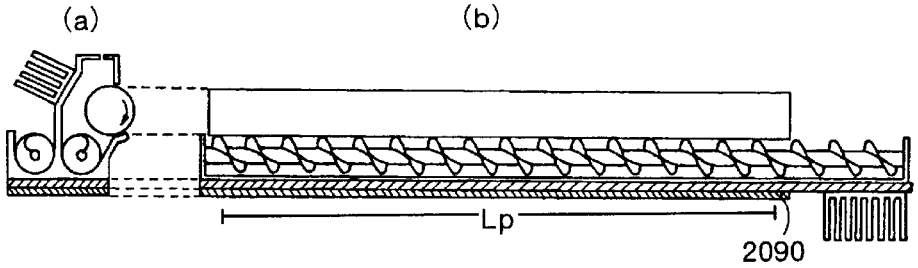
Figure 33:
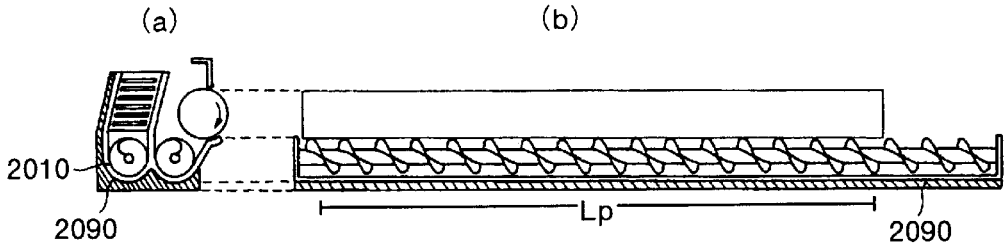
Figure 34:
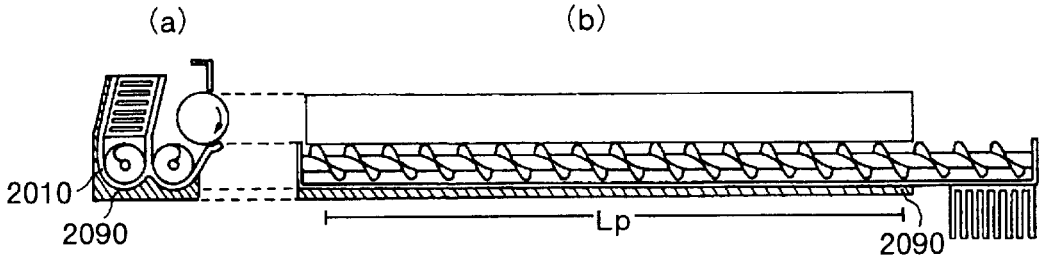
Figure 35:
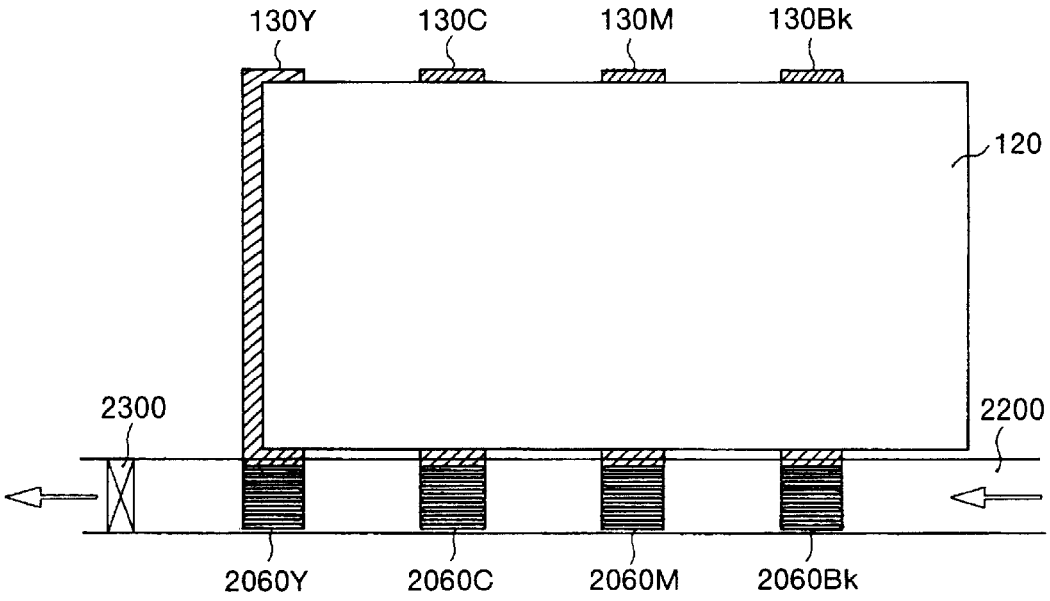
FIG. 35 is a bottom view of an image formation apparatus if air-cooling units are used.

Developers in an eighth modification are modifications of the developer in the eleventh embodiment and those in the first to seventh modifications and each constituted so that a heat insulating member 2090 is provided on the surface of the heat conductive member 2050 other than the portion in which the cooling fin is provided. The developer in the eighth modification which corresponds to that in the eleventh embodiment is shown in FIG. 27(*a*) and FIG. 27(*b*). The developers in the eighth modification which correspond to those in the first to seventh modifications are shown in FIGS. 28(*a*) and 28(*b*) to FIG. 34(*a*) and FIG. 34(*b*), respectively. In a normal color copier, various heat emission sources such as a motor, not shown, and a fixing device 15 are provided and the ambient temperature of the developer 130 is sometimes higher than that of the developer 130. In this case, there is fear that the heat conductive member 2050 which conducts the heat of the developer 130 to another position, conversely dissipates ambient heat and conducts the heat to the developer 130. To prevent this, the heat insulating member 2090 is provided on the surface of the heat conductive member 2050 other than the portion in which the cooling fin is provided, so as to insulate the ambient heat. As the material of the heat insulating member 2090, felt, foam resin, foam rubber or the like having low heat conductivity can be used.

As explained so far, according to the color copier in the eleventh embodiment, even with the layout on which there is no spatial room near the developer, it is possible to cool the developing material container of the developer.

Figure 17:
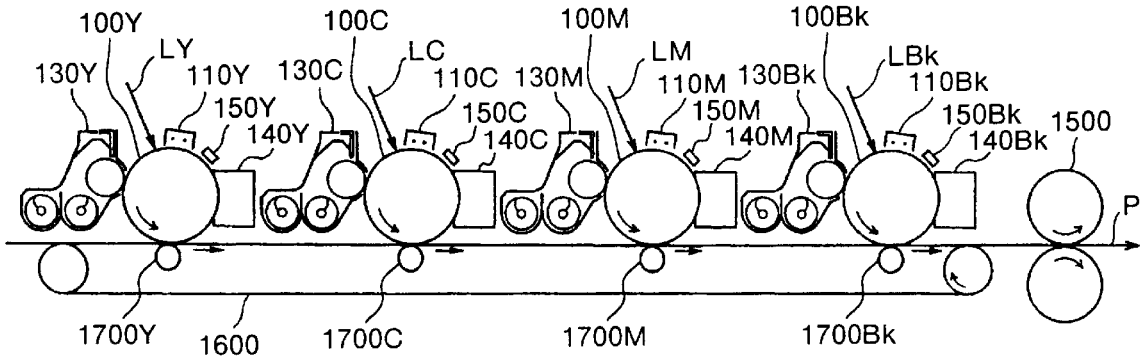
FIG. 17 is a schematic block diagram of an image formation section which employs a transfer/transport belt, FIG. 18(*a*) is a cross-sectional view of the surface of the developer perpendicular to the development sleeve axis, and FIG. 18(*b*) is a cross-sectional view of the developer which is viewed from the development sleeve longitudinal direction, FIG. 19(*a*) is a cross-sectional view of the surface of the developer perpendicular to the development sleeve axis in the eleventh embodiment, and FIG. 19(*b*) is a cross-sectional view of the developer which is viewed from the development sleeve longitudinal direction in the eleventh embodiment, FIG. 20(*a*) is a cross-sectional view of the surface of a developer perpendicular to the development sleeve axis in a first modification, and FIG. 20(*b*) is a cross-sectional view of the developer which is viewed from the development sleeve longitudinal direction in the first modification, FIG. 21(*a*) is a cross-sectional view of the surface of a developer perpendicular to the development sleeve axis in a second modification, and FIG. 21(*b*) is a cross-sectional view of the developer which is viewed from the development sleeve longitudinal direction in the second modification, FIG. 22(*a*) is a cross-sectional view of the surface of a developer perpendicular to the development sleeve axis in a third modification, and FIG. 22(*b*) is a cross-sectional view of the developer which is viewed from the development sleeve longitudinal direction in the third modification, FIG. 23(*a*) is a cross-sectional view of the surface of a developer perpendicular to the development sleeve axis in a fourth modification, and FIG. 23(*b*) is a cross-sectional view of the developer which is viewed from the development sleeve longitudinal direction in the fourth modification, FIG. 24(*a*) is a cross-sectional view of the surface of a developer perpendicular to the development sleeve axis in a fifth modification, and FIG. 24(*b*) is a cross-sectional view of the developer which is viewed from the development sleeve longitudinal direction in the fifth modification, FIG. 25(*a*) is a cross-sectional view of the surface of a developer perpendicular to the development sleeve axis in a sixth modification, and FIG. 25(*b*) is a cross-sectional view of the developer which is viewed from the development sleeve longitudinal direction in the sixth modification, FIG. 26(*a*) is a cross-sectional view of the surface of a developer perpendicular to the development sleeve axis in a seventh modification, and FIG. 26(*b*) is a cross-sectional view of the developer which is viewed from the development sleeve longitudinal direction in the seventh modification, FIG. 27(*a*) is a cross-sectional view of the surface of a developer perpendicular to the development sleeve axis in an eighth modification, and FIG. 27(*b*) is a cross-sectional view of the developer which is viewed from the development sleeve longitudinal direction in the eighth modification, FIG. 28(*a*) is a cross-sectional view of the surface of the developer perpendicular to the development sleeve axis in the eighth modification, and FIG. 28(*b*) is a cross-sectional view of the developer which is viewed from the development sleeve longitudinal direction in the eighth modification, FIG. 29(*a*) is a cross-sectional view of the surface of the developer perpendicular to the development sleeve axis in the eighth modification, and FIG. 29(*b*) is a cross-sectional view of the developer which is viewed from the development sleeve longitudinal direction in the eighth modification, FIG. 30(*a*) is a cross-sectional view of the surface of the developer perpendicular to the development sleeve axis in the eighth modification, and FIG. 30(*b*) is a cross-sectional view of the developer which is viewed from the development sleeve longitudinal direction in the eighth modification, FIG. 31(*a*) is a cross-sectional view of the surface of the developer perpendicular to the development sleeve axis in the eighth modification, and FIG. 31(*b*) is a cross-sectional view of the developer which is viewed from the development sleeve longitudinal direction in the eighth modification, FIG. 32(*a*) is a cross-sectional view of the surface of the developer perpendicular to the development sleeve axis in the eighth modification, and FIG. 32(*b*) is a cross-sectional view of the developer which is viewed from the development sleeve longitudinal direction in the eighth modification, FIG. 33(*a*) is a cross-sectional view of the surface of the developer perpendicular to the development sleeve axis in the eighth modification, and FIG. 33(*b*) is a cross-sectional view of the developer which is viewed from the development sleeve longitudinal direction in the eighth modification, FIG. 34(*a*) is a cross-sectional view of the surface of the developer perpendicular to the development sleeve axis in the eighth modification, and FIG. 34(*b*) is a cross-sectional view of the developer which is viewed from the development sleeve longitudinal direction in the eighth modification.

Further, in the eleventh embodiment, the two-component developer is used and the present invention has been explained while referring to the tandem type full-color copier which employs the intermediate transfer body as a transfer device. The present invention is also applicable to an image formation apparatus, such as a color copier, in which the transfer/transport belt is used as the transfer device and toner on the respective photosensitive bodies 100Y, 100C, 100M and 100Bk are sequentially transferred to the transfer body which is transported by the transfer/transport belt to thereby form an image as shown in FIG. 17. In this case, the same advantages can be attained. Further, the present invention is applicable not only to the color copier having the image carriers in tandem arrangement as explained in the eleventh embodiment but also to an image formation apparatus in which there is no spatial room near the developer. In this case, the same advantages can be attained, as well. Moreover, the present invention is applicable not only to the cooling of the two-component developer but also to the cooling of a one-component developer and the same advantages can be attained.

As explained so far, according to the present invention, in the developer which supplies the developing material contained in the casing to the image carriers by the developing material carriers, the high heat conductivity member having high heat conductivity is provided in the apparatus so as to contact with the developing material and the high heat conductive member is guided to the outside of the apparatus to thereby form the radiator. It is, therefore, possible to efficiently radiate the developing material having the largest heat emission in the developer, outside of and away from the apparatus. It is thereby possible to reduce layout limitations given by the cooling and to improve the degree of freedom for design.

Additionally, according to the present invention, even if there is no spatial room near the developer, it is possible to cool the developing material container of the developer.

The present document incorporates by reference the entire contents of Japanese priority documents, 2001-166694 filed in Japan on Jun. 1, 2001 and 2001-177001 filed in Japan on Jun. 12, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A developer comprising:

a carrier which supplies a developing material to an image carrier, wherein the developing material is contained in a casing;

a heat conductivity member having a first portion and a second portion, the first portion being located inside of the developer and making a physical contact with the developing material, and the second portion being located outside of the developer, wherein heat generated around the first portion of the heat conductivity member is conducted to the second portion of the heat conductivity member; and a radiator disposed on the second portion of the heat conductivity member, wherein the radiator radiates the heat conducted to the second portion of the heat conductivity member to the outside of the developer.

2. The developer according to claim 1, wherein the heat conductivity member forms a partition which enables circulating the developing material.

3. The developer according to claim 1, further comprising a developing material stirring and transporting unit which stirs and transports the developing material so that a liquid level of the developing material is directed toward the heat conductivity member.

4. The developer according to claim 1, wherein the casing includes a lower casing which contains the developing material and an upper casing which covers an upper portion of the lower casing, the heat conductivity member forms at least a part of the lower casing, and an outside of the heat conductivity member is covered with a heat insulating member.

5. A developer comprising:

a carrier which supplies a developing material which is contained in a casing, to an image carrier;

a heat conductivity member which contacts with the developing material; and a radiator which is formed by leading the heat conductivity member to an outside of the developer, wherein the casing includes a lower casing which contains the developing material and an upper casing which covers an upper portion of the lower casing, a developing material restriction member which restricts a thickness of the developing material on the carrier is provided on the upper casing side, and the heat conductivity member is provided in the upper casing to be contactable to the developing material which is intercepted by the developing material restriction member.

6. The developer according to claim 5, wherein the heat conductivity member comprises a protrusion which moves the intercepted developing material in an axial direction of the carrier.

7. The developer according to claim 1, wherein the heat conductivity member is a plane heat pipe.

8. A developer comprising:

a carrier which supplies a developing material which is contained in a casing, to an image carrier;

a heat conductivity member which contacts with the developing material; and a radiator which is formed by leading the heat conductivity member to an outside of the developer, wherein a portion of an inner wall surface of the casing includes a second heat conductivity member, the portion contacting with the developing material, and the second heat conductivity member contacts with the first heat conductivity member.

9. The developer according to claim 8, wherein the second heat conductivity member includes a low friction material.

10. The developer according to claim 8, wherein the second heat conductivity member includes a material having anisotropy in heat conduction.

11. The developer according to claim 1, wherein a portion of the casing in contact with the developing material is made of synthetic resin, and has a hollow structure.

12. The developer according to claim 1, wherein a portion of the casing in contact with the developing material has a hollow structure by extrusion, and includes a heat insulating material filled into a hollow portion of the hollow structure.

13. The developer according to claim 1, further comprising an air flow generation unit which generates an air flow which passes through the radiator.

14. The developer according to claim 13, wherein the radiator has a plurality of grooves through which the air flow passes, and a passage direction of the air flow is almost parallel to an axial direction of the image carrier.

15. The developer according to claim 13, wherein the radiator has a plurality of grooves through which the air flow passes, and a passage direction of the air flow is almost orthogonal to an axial direction of the image carrier.

16. The developer according to claim 1, wherein the radiator includes a Peltier element which serves as a heat exchange unit.

17. An image formation apparatus comprising a developer, the developer comprising:

a carrier which supplies a developing material to an image carrier, wherein the developing material is contained in a casing;

a heat conductivity member having a first portion and a second portion, the first portion being located inside of the developer and making a physical contact with the developing material, and the second portion being located outside of the developer, wherein heat generated around the first portion of the heat conductivity member is conducted to the second portion of the heat conductivity member; and a radiator disposed on the second portion of the heat conductivity member, wherein the radiator radiates the heat conducted to the second portion of the heat conductivity member to the outside of the developer, wherein an electrostatic latent image is formed on the image carrier by an optical writing unit and visualized as a toner image by the developer, and the toner image is transferred to a recording material.

18. The image formation apparatus according to claim 17, wherein the radiator radiates at least a part of a heat generated by the optical writing unit.

19. An image formation apparatus comprising:

a developer which includes a carrier which carries and transports a developing material, a developing material container which contains the developing material which is supplied by the carrier, and a developing material stirring and transporting member which stirs the developing material in the developing material container;

a heat conductive member having a first portion and a second portion, the first portion being located inside of the developer and making a physical contact with the developing material, and the second portion being located outside of the developer, wherein heat generated around the first portion of the heat conductive member is conducted to the second portion of the heat conductive member; and a cooling unit which cools the heat conducted by the heat conductive member at the second portion.

20. The image formation apparatus according to claim 19, wherein the heat conductive member extends relatively to an image formation region in a longitudinal direction of the developing material container, and the cooling unit cools a region of the heat conductive member, the region extended relatively to the image formation region.

21. The image formation apparatus according to claim 20, wherein the developing material container extends relatively to the image formation region in the longitudinal direction.

22. The image formation apparatus according to claim 19, wherein the heat conductive member includes aluminum.

23. The image formation apparatus according to claim 19, wherein the heat conductive member includes copper.

24. The image formation apparatus according to claim 19, wherein the heat conductive member includes a heat pipe.

25. The image formation apparatus according to claim 19, wherein the heat conductive member includes a meander narrow tube type heat pipe.

26. The image formation apparatus according to claim 19, wherein the developing material container integrally includes the heat conductive member.

27. The image formation apparatus according to claim 19, wherein the developing material container and the heat conductive member include different members, and are thermally, closely attached to each other.

28. The image formation apparatus according to claim 19, wherein portions of the heat conductive member other than a portion of the heat conductive member cooled by the cooling unit, are covered with a heat insulating member.

29. The image formation apparatus according to claim 19, wherein the cooling unit includes a heat dissipator which uses an air flow.

30. The image formation apparatus according to claim 19, wherein the cooling unit includes a heat dissipator which uses a liquid flow.

31. The image formation apparatus according to claim 19, wherein a portion of the heat conductive member which is cooled by the cooling unit includes a heat sink.

32. The image formation apparatus according to claim 19, comprising:

a plurality of image carriers which are arranged in parallel;

the developer which individually forms images on the plurality of image carriers; and a transfer device which transports a transfer body and which sequentially transfers toner images which are formed on the plurality of image carriers, to the transfer body.

33. The image formation apparatus according to claim 19, comprising:

a plurality of image carriers which are arranged in parallel;

the developer which individually forms images on the plurality of image carriers;

an intermediate transfer body to which toner images, which are formed on the plurality of image carriers, are sequentially transferred; and a transfer device which transfers the images on the intermediate transfer body, to the transfer body.

* * * * *